US005296901A

United States Patent [19]

Davies

[11] Patent Number: 5,296,901

[45] Date of Patent: Mar. 22, 1994

[54] ELECTRIC CONTACT FOR DRY TONER CARTRIDGE

[76] Inventor: Wilkins L. Davies, P.O. Box 4806, Clearwater, Fla. 34618

[21] Appl. No.: 823,290

[22] Filed: Jan. 21, 1992

[51] Int. Cl.[5] ..... G03G 15/06

[52] U.S. Cl. ..... 355/260; 118/658; 439/849

[58] Field of Search ..... 355/260, 245, 251, 253, 355/299; 439/845, 849, 850; 118/657, 658

[56] References Cited

U.S. PATENT DOCUMENTS 3,320,574 5/1967 Tuchel ..... 439/850 X
3,771,111 11/1973 Pritulsky ..... 439/850
4,271,785 6/1981 DiNallo, Sr. et al. ..... 355/260 X

*Primary Examiner*—Leo P. Picard
*Assistant Examiner*—Christopher Horgan
*Attorney, Agent, or Firm*—D. A. Kiewit

[57] ABSTRACT

An improved toner cartridge and contact which pertains to the recycling of the cartridge is disclosed by providing an alternate or additional way of completing the electrical bias connection to the magnetic feed roller by the addition of a simple contact, which is attached to a doctor blade, having a finger extending to ride onto the surface of the magnetic roller. This contact can be attached at either end, or both ends, of the doctor blade thereby connecting the doctor blade to the feed roller, the contact being held in place by the hold-down screws of the doctor blade.

4 Claims, 1 Drawing Sheet

ELECTRIC CONTACT FOR DRY TONER CARTRIDGE

FIELD OF INVENTION

This invention relates to toner cartridges that are used for copy machines and digital printers. More specifically, the present invention relates to an improved, recycled toner cartridge that provides for darker and smoother, even prints.

BACKGROUND OF THE INVENTION

Specifically speaking of some dry toner cartridge manufacturers, it is their intent that users of their toner cartridges replace them after initial use. In this regard, the number of cartridges purchased is far in excess of those that would be purchased if they could be maintained or recycled. In fact, a subindustry of toner cartridge recyclers has evolved because of the need to reduce the high costs involved in operating copy machines and digital printers. It is much less expensive to recycle a used cartridge than to replace it with a new one.

The toner cartridge, which contains the photo conductive drum and a toner bin body with a magnetic feed roller device and a corona wire to charge the drum, along with a wiper blade and dust bin to clean the drum and collect the waste, comprises an important part of the copier or printer. It is about seventy percent (70%) of the image-making portion of the machine. In addition, the cartridge has light shutters and a protective door flap for the drum and, in some cases, geared counters to indicated approximate toner level, all of which combine to make this an expensive product for the ultimate consumer.

In operation, toner particles (approximately 10 microns in size) are transferred from the toner bin onto the magnetic feed roller by magnetic attraction; the toner contains iron-like particles which are magnetically attractable. Here they are leveled onto the surface of the feed roller in a thin layer by a doctor blade. The toner becomes charged, by a rubbing action against the doctor blade, as it rotates onto the magnetic feed roller. The magnetic feed roller operates at a bias voltage of several hundred volts, mixed with an alternating ripple voltage providing the impetus for the statically charged toner particles to be transferred from the magnetic feed roller onto the charged photoconductive drum surface, thereby forming an image from the photo-electromagnetic radiation information having been received on the photoconductive drum surface. Toner particles seek the areas on the drum that are of a different intensity of charge, though not necessarily opposite charge. The final print image is produced by transference of toner particles from the photo conductive drum onto a medium of choice resulting in a finished printed product. This is accomplished by the printed medium, or paper, being charged by a corona wire (or other means) in an opposite polarity of the toner particles. The toner thusly lying in place on the print medium is then melted or pressed onto that medium, thereby achieving a permanent print.

Due to factory construction and design of certain dry ink processing cartridges used in copy machines and digital printers, toner dust enters into an area of critical electrical connection at the bias voltage rotating connection of the magnetic roller. This accumulated toner, mixed with oxidized metal particles from the contacts, disrupts continuity of electrical connection.

Subsequent to repeated use of the toner cartridge, the aforementioned toner particles and oxidized metal particles accumulate within the critical point of electrical connection thus inhibiting a smooth transference of toner from the feed roller onto the photoconductive drum. This problem is exacerbated by a factory produced, thin film of lubricant at the point of rotating electrical connection of the magnetic feed roller, thereby causing the particles to adhere to the lubricant and remain in the contact area.

When the foreign particles accumulate in this area of electrical connection, minute variations of bias voltage result which affects the transference of the toner onto the photoconductive drum. This is especially noticeable where graphics having large black images are used, or where half-toned dots are involved. If the cartridge is recycled at this point, it is typically disassembled and cleaned to remove the foreign particles from the electrical contact area. Additionally, the lubricant is usually wiped away to prevent further coagulation of new particles in that area. However, it is cumbersome and time consuming to disassemble the bias electrical connection and clean the contacts.

SUMMARY OF THE INVENTION

This invention relates to an improvement in the toner cartridge as pertaining to the recycling of the cartridge by providing an alternate or additional means of completing the electrical bias connection to the magnetic feed roller by the addition of a simple contact member, which is attached to the doctor blade, having a finger extending to ride on the surface of the magnetic roller. This contact member can be attached at either end, or both ends, of the doctor blade thereby connecting the doctor blade to the feed roller, the contact member being held in place by the hold-down screws of the doctor blade.

The contact member employs an extension or finger which comes into physical contact with the external face of the feed roller, thereby eliminating the need to go through the laborious routine of cleaning the original contact points installed by the factory, which are located within the sleeve surrounding the stationary magnetic core of the feed roller. Further, a used toner cartridge need not be disassembled to repair the contact area since the second contact provides for an alternate route of electrical connection and is an add-on piece to the existing toner cartridge.

BRIEF DESCRIPTION OF THE DRAWINGS

The features embodying the present invention are illustrated in the accompany drawing, forming a part of this application, in which.

DETAILED DESCRIPTION OF A PREFERRED EMBODIMENT

Figure 1:
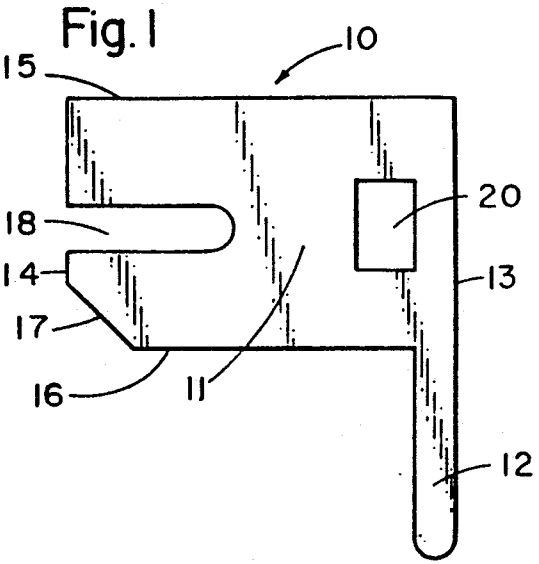
FIG. 1 is top plan view of the contact.

A detailed description of a preferred embodiment of the invention may be seen in FIG. 1. Specifically, an electrically conductive contact member 10 is shown having a flat body portion (e.g. a contact face 11) and a contact member finger 12. The contact member 10 has two substantially parallel end sides, 13 and 14, respectively, and a top 15 and a bottom 16 which are also substantially parallel to one another. The contact finger 12 extends downwardly from the bottom 16 of the contact member 10 on the first end side 13. The contact finger may be of any length to allow it to come into contact with the magnetic feed roller 33 as seen in FIG. 2, approximately 0.300–0.400 inches, but optimally is of a length of 0.366 inches.

A section of contact member 10 has a cutout 17 located at the corner of its bottom 16 adjacent to the second end side 4. The cutout 17 accommodates the configuration of the toner bin body 30 as further seen in FIG. 2. A hold-down screw slot 18 is positioned beginning at approximately the middle of the second end side 14 terminating toward the first end side 13 along the approximate middle of contact face 11. The slot 18 is of sufficient length to accommodate the hold-down screw 19 attached to the doctor blade 31 as seen in FIG. 2. Additionally, a squared aperture 20 is located along the contact face 11 which is toward the first end side 13 of the contact 10 and approximately equidistant between the top 15 and bottom 16 thereof. This aperture 20 accepts the size and dimension of the locating boss 21 positioning the doctor blade 31.

Figure 2:
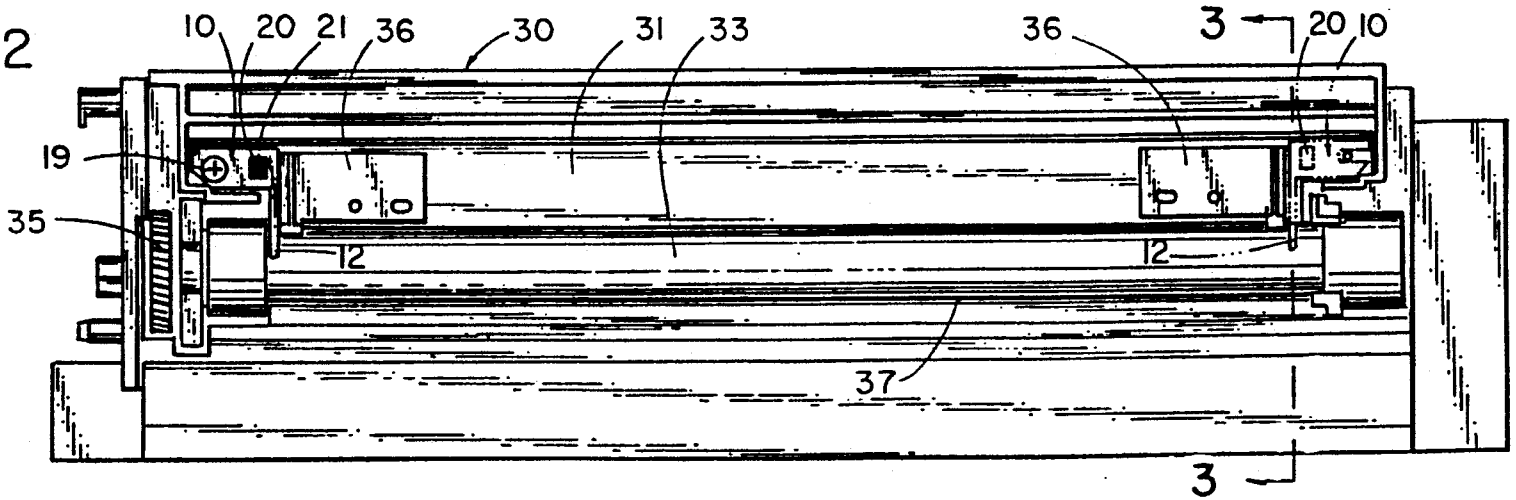
FIG. 2 is a front plan view of an improved toner cartridge employing the contact.

The toner bin body 30 of a toner cartridge (not shown) is illustrated in FIG. 2. The electrically conductive contact member 10 shown on doctor blade 31, which metes out toner 32 (FIG. 3), may be present on either end thereof, or, in some cases, on both ends (one contact 10 is shown in phantom lines).

Figure 3:
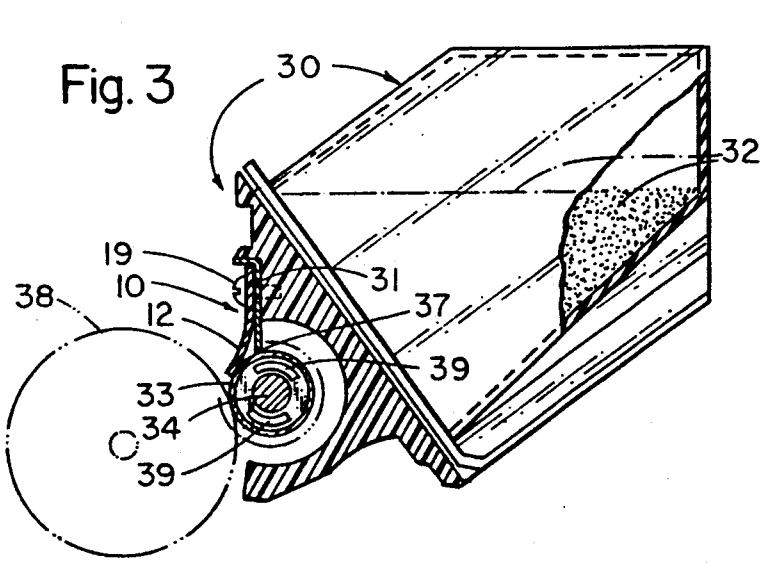
FIG. 3 is a cross section view of FIG. 2 taken at line "3".

Referring more specifically to FIG. 2 and FIG. 3, the toner bin body 30 contains dry ink toner 32. The toner 32 is in direct physical contact with the magnetic feed roller 33 of the toner cartridge. The toner 32 is magnetically attracted to the magnetic feed roller 33 as the feed roller 33 has concentrically located within it a stationary magnet 34. As the magnetic feed roller 33 rotates, driven by gear 35, the dry ink toner 32 is rotated out of the toner bin body 30 against the doctor blade 31. The doctor blade 31 smoothes the toner 32 to an even film onto the feed roller 33 in a pre-measured thickness as determined by a nylon spacer 36. A small angled finger on the spacer 36 wraps around the edge of the doctor blade 31 and is in contact with the surface of the feed roller 33, thereby establishing the pre-measured gap opening 37.

Contact member 10 is secured to the doctor blade 31 by a hold down screw 19 such that contact finger 12 is in direct physical contact with the magnetic feed roller 33. Since the doctor blade 31 is connected to the same electrical circuit that charges the magnetic feed roller 33, an electrical circuit is created between the doctor blade 31, the contact member 10 and the magnetic feed roller 33. This circuit allows for the statically charged toner 32 to be transferred from the feed roller 33 onto the surface of the charged photoconductive drum 38 (shown in phantom lines in FIG. 3) thus bypassing the interrupted electrical connection of the factory installed contacts 39 as heretofore mentioned.

It is intended that the description of the preferred embodiment of this invention is illustrative only. Other embodiments of the invention that are within the scope and concept of it are herein included and made a part of this application.

What I claim is:

1. An improved dry toner cartridge for use in a copy machine or a digital printer, said improvement comprising an external electrical contact member for bypassing an interruptable factory-installed electrical contact, said factory-installed contact providing a frictional electrical connection internal to a rotatable metallic toner roller, wherein said external contact member is attached to a doctor blade and wherein said external contact member includes a contact finger of sufficient length to make a tangential rubbing connection to an external curved surface of said toner roller.

2. In an improved toner cartridge of claim 1, said external electrical contact member adapted for visual inspection.

3. An improved toner cartridge of claim 1 further comprising a plurality of said external contact members.

4. An improved toner cartridge of claim 1 wherein said external contact member is attached to said doctor blade by means of a screw.

* * * * *